US005669357A

United States Patent [19]

Denz et al.

[11] Patent Number: 5,669,357

[45] Date of Patent: Sep. 23, 1997

[54] CYLINDER-SELECTIVE INJECTION SYSTEM

[75] Inventors: Helmut Denz, Stuttgart; Winfried Moser, Ludwigsburg; Wolfgang Höptner, Uhingen; Helmut Gross, Gerlingen; Christian Klinke, Pleidelsheim; Karl-Heinz Gerlings, Salzgitter; Klemens Grieser, Langenfeld; Klaus Bottcher, Oberriexingen, all of Germany

[73] Assignee: Robert Bosch GmbH, Stuttgart, Germany

[21] Appl. No.: 636,710

[22] Filed: Apr. 23, 1996

Related U.S. Application Data

[63] Continuation of Ser. No. 297,727, Aug. 29, 1994.

[30] Foreign Application Priority Data

Aug. 27, 1993 [DE] Germany ..... 43 28 835.9

[51] Int. Cl.[6] ..... F02D 7/00

[52] U.S. Cl. ..... 123/481

[58] Field of Search ..... 123/481, 332, 123/325, 479, 339.1, 339.14, 198 F; 364/426.02; 180/197

[56] References Cited

U.S. PATENT DOCUMENTS

| | | | |
|---|---|---|---|
| 4,242,991 | 1/1981 | Scherenberg et al. | 123/326 |
| 4,250,853 | 2/1981 | Harada et al. | 123/326 |
| 5,018,595 | 5/1991 | Hara et al. | 123/332 |
| 5,025,881 | 6/1991 | Poirier et al. | 180/197 |
| 5,119,781 | 6/1992 | Trombley et al. | 123/325 |
| 5,136,996 | 8/1992 | Kushi et al. | 123/332 |
| 5,154,151 | 10/1992 | Bradshaw et al. | 123/481 |
| 5,168,952 | 12/1992 | Oono et al. | 123/481 |
| 5,275,143 | 1/1994 | Lembke et al. | 123/479 |
| 5,287,279 | 2/1994 | Anan | 364/426.02 |

*Primary Examiner*—Raymond A. Nelli
*Attorney, Agent, or Firm*—Kenyon & Kenyon

[57] ABSTRACT

In a cylinder-selective injection system for an internal combustion engine, there are cylinder-selective injection suppressions. Subsequent to the suppressions, restoring added quantities specific to an individual cylinder are generated, whose initial value is dependent upon the number of suppressed injections for the cylinder in question, and whose notching-down to zero is dependent upon the number of injections of the cylinder that have taken place after completion of the suppression.

16 Claims, 3 Drawing Sheets

CYLINDER-SELECTIVE INJECTION SYSTEM

This application is a continuation of application Ser. No. 08/297,727, filed on Aug. 29, 1994.

FIELD OF THE INVENTION

The present invention relates to a fuel-injection system and in particular to a cylinder-selective injection system having an alternating pattern.

BACKGROUND OF THE INVENTION

German Patent Application No. DE 36 23 040 describes a cylinder-selective injection system, where the fuel supply is cut off during deceleration, the number of cylinders to be switched off being specified. An alternating pattern is provided specifying those cylinders which are not supplied with fuel, to prevent individual cylinders from cooling off too drastically.

SAE Technical Paper No. 920641, entitled *Traction Control (ASR) Using Fuel-Injection Suppression—A Cost Effective Method Of Engine-Torque Control*, depicts a special pattern of active cylinders in FIG. 6, and the caption reads, *Torque Reduction Stages with Alternating Fuel-Injection Suppression*. At page 40 is described corrections to be made when restoring the fuel supply, so that the wall film may be rapidly built up again in the air intake tube.

It turns out that, in view of pollutant characteristics and ride comfort, considerable efforts must be made with respect to the restoring of the fuel supply. Therefore, an object of the present invention is to introduce an optimal solution for this operating state.

SUMMARY OF THE INVENTION

The present invention relates to a mixture-compressing internal combustion engine having cylinder-selective injection. A basic idea underlying the present invention is a cylinder-selective injection suppression, as well as a cylinder-specific restoring added fuel quantity for traction control, deceleration fuel cutoff, and rotational-frequency or speed limitation. The initial value of the added fuel quantity when the fuel supply is restored depends on the number of suppressed injections for the cylinder in question; and gradual return to zero of the added fuel quantity depends on the number of injections of the cylinder that have taken place after completion of the suppression operation.

As far as restoring the fuel quantity is concerned, the cylinder-selective injection system according to the present invention makes it possible to attain an excellent ride comfort while simultaneously achieving good exhaust emission specifications.

DETAILED DESCRIPTION

Figure 1:
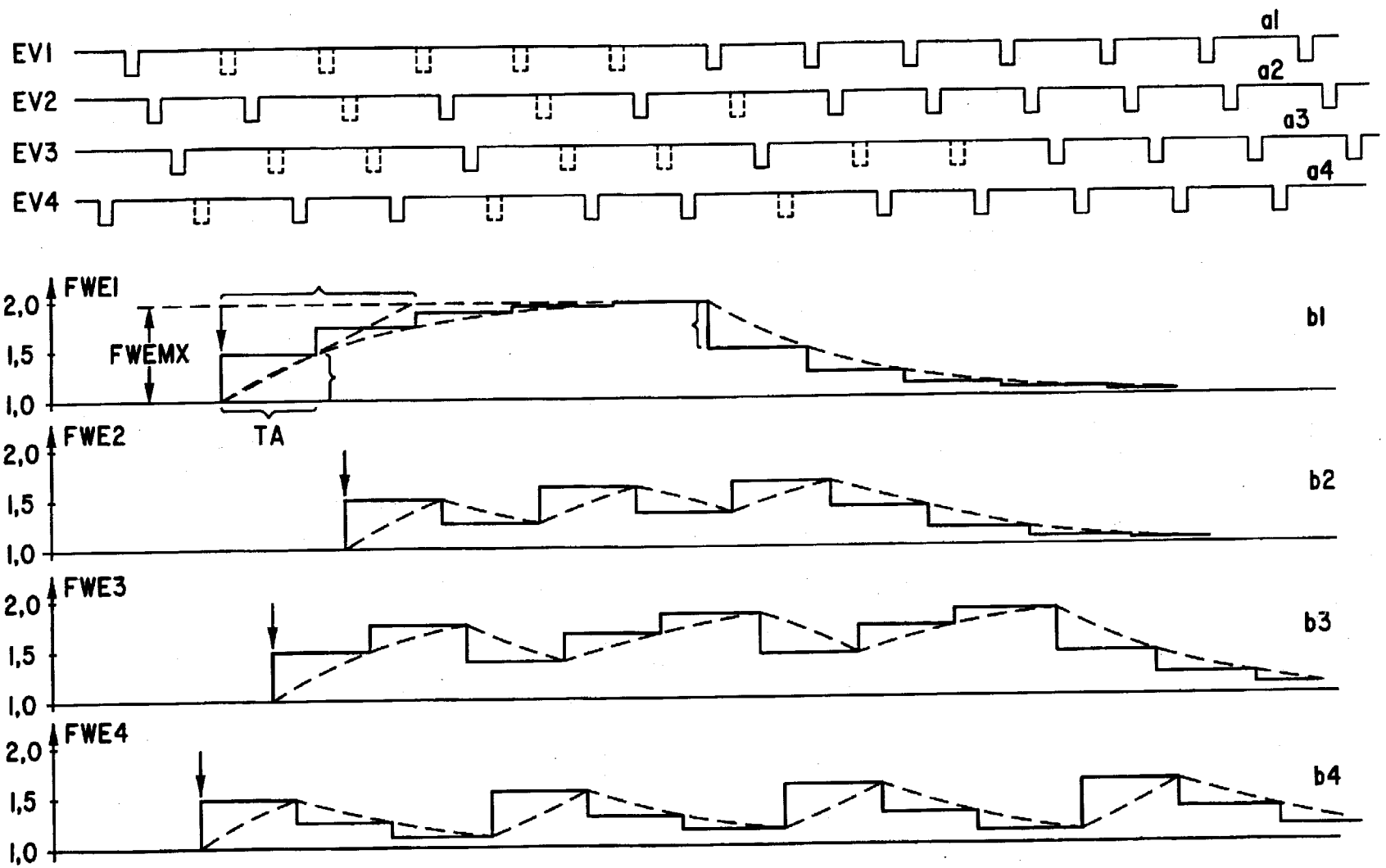
FIG. 1 shows pulse diagrams of injections that are taking place and those that are suppressed, as well as the time characteristic of the added quantity factor.

Referring to FIG. 1, the cylinder-selective injections of the four injection valves EV1 through EV4 are depicted with cylinder-specific suppressions (shown with a dotted line). The diagrams b1 through b4 in FIG. 1 show the characteristic curves of the cylinder-specific added quantities (FWE1–4) in dependence upon the number of injections that have occurred since the most recent suppression. One can discern that the added fuel quantity (FWE1) apparent in FIG. 1, diagram b1 for the cylinder 1 is notched up to larger values, beginning with the first suppression. The maximum value of the added fuel quantity (FWE1) tends toward a limiting value FWEMax. At the end of the suppressions, i.e., when the injections are restored, the value of the added fuel quantity is taken away with every injection, until this added fuel quantity has been taken away completely after a few injections.

In conjunction with diagram b2, diagram a2 depicts a pattern with an alternating injection and suppression. One can discern that a certain added fuel quantity is made available with each missing injection, and that the added fuel quantity is taken away at the beginning of each injection.

In conjunction with diagram b3, diagram a3 depicts a comparable pattern, one injection following after two suppressions.

Finally, diagrams a4 and b4 show a pattern where two injection pulses follow a suppression.

Discernible in all the diagrams according to FIG. 1, diagrams b1–b4 is a large initial increase in the desired added fuel quantity that becomes effective later on, and a withdrawal of the increase in this added fuel quantity with each additional suppressed cylinder. If an injection again takes place following the suppression, then the prevailing added fuel quantity is also reduced with a decreasing tendency.

Figure 2:
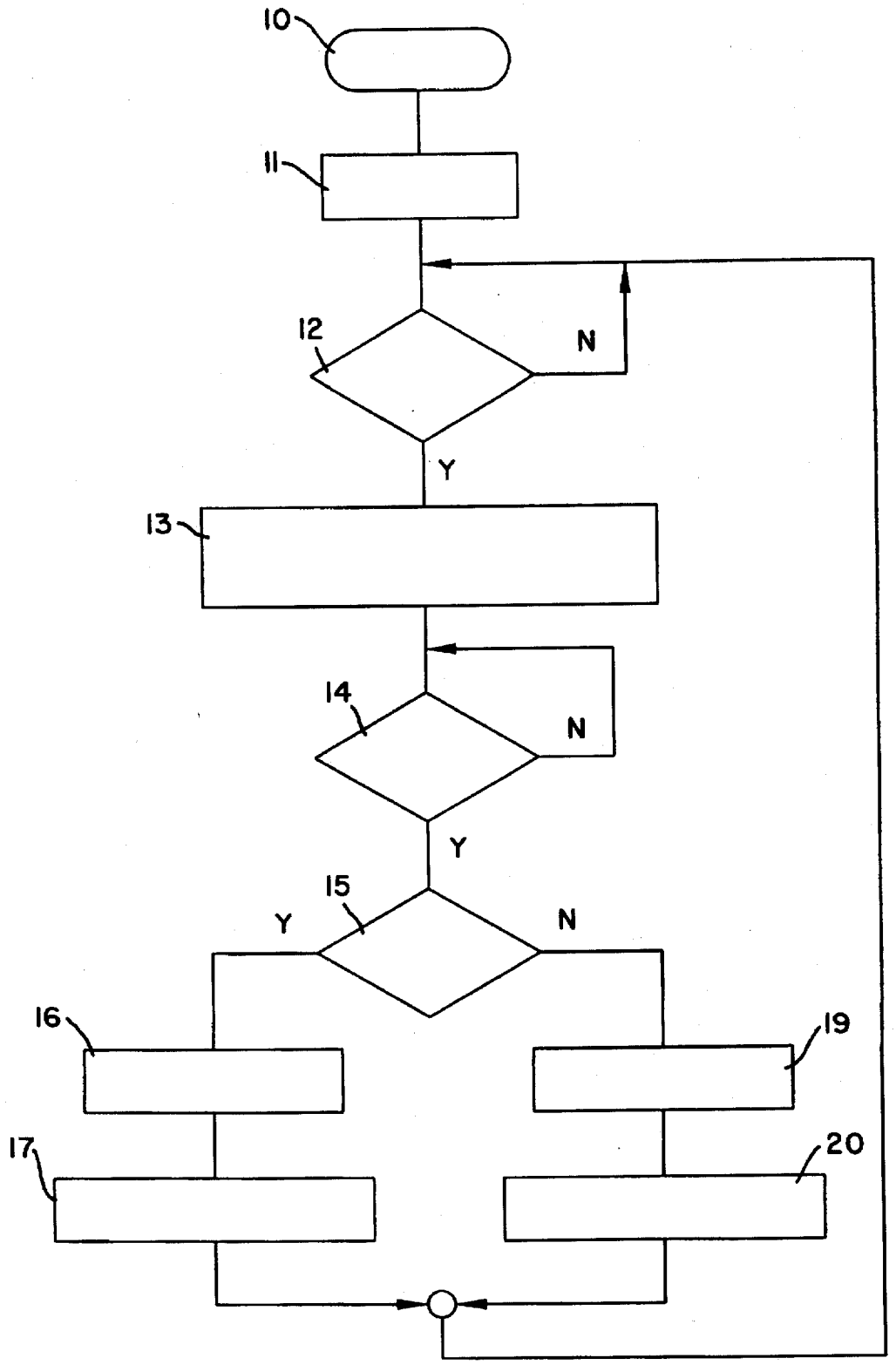
FIG. 2 shows a flow chart for calculating the injection period for an individual cylinder according to the present invention.

A possibility for realizing the curve shapes of FIG. 1, diagrams b1–b4 in terms of software is depicted in the flow chart of FIG. 2 which shows an injection of suppression cycle for cylinder 1.

Referring now to FIG. 2, there is depicted the flow chart for calculating the period of the injection signal and its outputting to an individual injection valve, given a cylinder-selective restoring added fuel quantity. Due to the cylinder-selective injection-quantity control, the program flow described in the following is required for each cylinder.

FIG. 2 shows the following steps:

An initialization is denoted by step 10. In step 11, a restoring added fuel quantity is set to the value 1 in accordance with the formula:

$$fwe_1=1.$$

In step 12, it is determined whether the arc of crankshaft rotation has been reached for calculating the injection time of the cylinder. If the proper crankshaft rotation has been reached, then the injection period, as well as the start of injection angle for the next injection are calculated in the step 13 in accordance with the formula:

$$ti_1=t1*\pi Fi*fwe_1+tvub$$

$$\text{gamma } KW_1=f(n,\ ti_1,\ wee),$$

in which case,

πFi=the product of the correction factors;

tvub=battery-voltage correction;

n=speed; and wee=angle for the end of injection.

Step 13 is followed by step 14 where it is determined whether the start-of-injection angle gamma KW_1 has been reached. The subsequent step 15 determines whether a suppression bit is set for the cylinder or not (EV1=injection valve 1). If a suppression bit is set, this signifies that, in accordance with step 16, the injection has not been started. This is followed by step 17 for calculating the added fuel quantity (FWE1) in accordance with the formula:

$$fwe_1=fwe_1+(FWEMX-fwe_1)*ZWEAUF$$

or generally expressed as:

$$fwe_i(a)=fwe_i(a-1)+[FWEMX-fwe_i(a-1)]*ZWEAUF,$$

in which case, a=the number of suppressions of the cylinder i in question;

FWEMX=maximum value of the added fuel quantity;

ZWEAUF=the added quantity notching-up rate; and fwe_i (0)=1, or

=the last notching-down (gradual shut-off) value fwe_i (k) to be reached, in the case that a notching-down to 1 was not quite completed.

The result of the injection-synchronous calculation, given a constant ZWEAUF, is that the notching-up time constant TauAUF is inversely proportional to the speed, as the following formula to be derived from FIG. 1 shows:

$$TauAUF=TA/ZWEAUF,$$

in which case, TA=the period of time between two regular injection-time outputs. Any desired speed-dependent value can be reached for TauAUF by selecting a speed-dependent value for ZWEAUF.

If the query in step 15 has not resulted in any set suppression bit, then, according to step 19, this signifies a start of the injection with the injection time calculated in step 13. For the subsequent injection, the added fuel quantity to be notched-down is determined according to the following formula:

$$fwe_1=fwe_1+(1-fwe_1)*ZWEAB$$

Expressed generally, this formula means that after the injection for one cylinder i is restored, the added fuel quantity is notched-down according to the formula:

$$fwe_i(k)=fwe_i(k-1)+[1-fwe_i(k-1)]*ZWEAB,$$

in which case, k=the number of injections after suppression of the cylinder i in question;

ZWEAB=the added-quantity notching-down rate; and fwe_i (0)=the last notching-up value to be reached fwe_i (a).

Analogously to TauAUF, the statements on speed dependency and the following formula apply for the notching-down time constant TauAB:

$$TauAB=TA/ZWEAB,$$

in which case, TA=the period of time between two regular injection-time outputs.

Both calculation steps 17 and 20 lead back to step 12.

The following points are of fundamental importance to the invention:

For each cylinder, an added-quantity calculation is performed, which is dependent upon the number of suppressed injection pulses for the special cylinder, or rather upon the number of injection pulses that have followed after at least one suppression.

The added fuel quantity can thereby have a multiplicative or cumulative effect on the load signal t1 as the quotient of mass rate of air flow and speed.

For the notching-up of a cumulative added fuel quantity to be calculated at the start of suppression of the injections for a cylinder i, the following formula applies (in comparison to the above-mentioned formulae, "f" is replaced by "ad"):

$$adwe_i(a)=adwe_i(a-1)+[ADWEMX-adwe_i(a-1)]*ZWEAUF$$

For the notching-down, the following formula applies:

$$adwe_i(k)=adwe_i(k-1)+[1-adwe_i(k-1)]*ZWEAB$$

Changes in the above-mentioned exemplified embodiment for the added-value calculation are conceivable in so far as the initial added fuel quantity is not dependent upon the number of suppressions, but rather is fixed. In all cases, however, the maximum added fuel quantity (in this case FWEMX) is made dependent upon operating parameters for the engine, such as speed, load, or engine temperature. In the same way, the notching-up and notching-down time constants (ZWEAUF, ZWEAB) can be made dependent on such operating parameters for the engine.

In a simple variation, the control time constant (engine-timing constant) is zero, i.e., only the first injection pulse comprises an added fuel quantity after the suppression.

Figure 3:
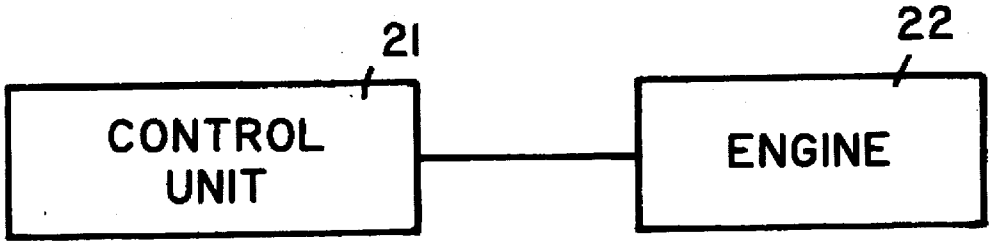
FIG. 3 shows a block diagram of the apparatus according to the present invention.

In FIG. 3, a block diagram of the apparatus according to the present invention shows the control unit 21 connected to the engine block 22. The control unit 21 controls fuel injection to the individual cylinders of the engine block 22, performing the method steps previously outlined.

The principal advantage of the cylinder-selective injection system according to the present invention is that it makes it possible to guarantee combustion after a desired number of cylinder-selective suppressions. Finally, a desired lambda characteristic is attained in the best possible way for each individual cylinder, even after the suppressions have taken place.

In the claims:

1. An apparatus for controlling a cylinder-selective fuel injection system for an internal combustion engine having cylinder-selective fuel injection suppression for providing a reduction in drive torque to effect at least one of traction control, deceleration fuel cutoff, and rotational speed limitation, comprising:

a control unit coupled to the fuel injection system, the control unit performing the steps of:

determining an added fuel quantity to be fed to each cylinder of the engine upon restoration of fuel injection to the respective engine cylinder;

initializing the added fuel quantity for each engine cylinder based upon a number of suppressed fuel injections for the respective engine cylinder;

decrementing the added fuel quantity for each engine cylinder to zero based upon a number of fuel injections to the respective engine cylinder taking place after the number of suppressed fuel injections; and applying the added fuel quantity for each engine cylinder to the fuel injection system so that the fuel injection system injects a fuel injection quantity including the added fuel quantity into each respective engine cylinder.

2. The apparatus according to claim 1, further comprising a plurality of restoring added fuel quantities, and a plurality of gradual return to zeros for respective engine cylinders.

3. The apparatus according to claim 1, wherein the at least one restoring added fuel quantity notches-up according to the formula:

$$fwe_i(a)=fwe_i(a-1)+[FWEMX-fwe_i(a-1)]*ZWEAUF,$$

wherein:

a=the number of suppressed injections for the respective engine cylinder;

FWEMX=a maximum value of the at least one restoring added quantity;

ZWEAUF=an added-quantity notching-up rate; and fwe_i (0)=1, or

=a last notching-down value to be reached when a notching-down to 1 is not completed.

4. The apparatus according to claim 3, wherein a notching-up time constant, TauAUF, inversely proportional to speed is defined according to the formula:

$$TauAUF=TA/ZWEAUF,$$

wherein TA=a period of time between two injection-time outputs.

5. The apparatus according to claim 1, wherein the at least one restoring added fuel quantity notches-down according to the formula:

$$fwe_i(k)=fwe_i(k-1)+[1-fwe_i(k-1)]*ZWEAB,$$

wherein:

k=the number of injections to the respective engine cylinder taking place after a suppressed injection;

ZWEAB=an added-quantity notching-down rate; and fwe_i(0)=a last notching-up value to be reached.

6. The apparatus according to claim 5, wherein a notching-down time constant, TauAB, inversely proportional to speed is defined according to the formula:

$$TauAB=TA/ZWEAB,$$

wherein TA=a period of time between two injection-time outputs.

7. The apparatus according to claim 3, wherein at least one cumulative restoring added fuel quantity notches-up according to the formula:

$$adwe_i(a)=adwe_i(a-1)+[ADWEMX-adwe_i(a-1)]*ZWEAUF.$$

8. The apparatus according to claim 5, wherein at least one cumulative restoring added fuel quantity notches-down according to the formula:

$$adwe_i(k)=adwe_i(k-1)+[1-adwe_i(k-1)]*ZWEAB.$$

9. The apparatus according to claim 3, wherein the maximum value of the at least one restoring added fuel quantity is dependent upon at least one predetermined engine operating parameter.

10. The apparatus according to claim 3, wherein the added-quantity notching-up rate is dependent upon at least one predetermined engine operating parameter.

11. The apparatus according to claim 5, wherein the added-quantity notching-down rate is dependent upon at least one predetermined engine operating parameter.

12. A method for controlling a cylinder-selective fuel injection system for an internal combustion engine having cylinder-selective fuel injection suppression for providing a reduction in drive torque by providing at least one of traction control, deceleration fuel cutoff, and rotational speed limitation, comprising the steps of:

(a) calculating an injection time and angle for a next fuel injection or fuel suppression for the engine cylinder;

b) checking a state of a suppression bit;

c) calculating a value for a restoring added fuel quantity, the value being dependent upon a number of prior fuel suppressions and a notching-up rate if the suppression bit is set, and being dependent upon a number of fuel injections and a notching-down rate if the suppression bit is not set; and d) performing the next fuel injection or fuel suppression by injecting a fuel injection quantity including the restoring added fuel quantity into the engine cylinder if the suppression bit is not set, and by refraining from injecting fuel if the suppression bit is set.

13. The method according to claim 12, wherein a plurality of restoring added fuel quantities are calculated and injected.

14. The method according to claim 12, wherein the restoring added fuel quantity has a maximum value dependent upon at least one predetermined engine operating parameter.

15. The method according to claim 12, wherein the notching-up rate is dependent upon at least one predetermined engine operating parameter.

16. The method according to claim 12, wherein the notching-down rate is dependent upon at least one predetermined engine operating parameter.

* * * * *